United States Patent [19]

King

[11] 4,106,260

[45] Aug. 15, 1978

[54] ARTICLE FOLDING AND PACKAGING SYSTEM

[75] Inventor: J. Frank King, Winston-Salem, N.C.

[73] Assignee: Hanes Corporation, Winston-Salem, N.C.

[21] Appl. No.: 727,756

[22] Filed: Sep. 29, 1976

[51] Int. Cl.[2] ..... B65B 63/04; B65B 63/08; B65H 45/18; B65H 45/30

[52] U.S. Cl. ..... 53/21 FW; 53/117; 53/120; 53/124 R; 53/127; 223/37; 270/66

[58] Field of Search ..... 53/117, 189, 116, 120, 53/21 FW, 124 R, 124 D, 127; 270/66, 67, 86, 94; 223/37, 71; 271/14

[56] References Cited

U.S. PATENT DOCUMENTS

| | | | |
|---|---|---|---|
| 3,194,551 | 7/1965 | Herr et al. | 271/14 |
| 3,292,340 | 12/1966 | Smith, Jr. et al. | 53/117 X |
| 3,742,676 | 7/1973 | Lawing et al. | 53/117 X |
| 3,774,903 | 11/1973 | Sjoman et al. | 270/86 X |
| 3,806,007 | 4/1974 | Grantham | 223/37 |
| 3,827,611 | 8/1974 | Grantham et al. | 223/37 |
| 3,828,989 | 8/1974 | Heater | 223/37 |
| 3,829,081 | 8/1974 | Gerstenberger et al. | 270/86 X |
| 3,877,562 | 4/1975 | Shaw | 53/189 X |
| 3,965,647 | 6/1976 | Sjoman | 223/37 X |

*Primary Examiner*—Horace M. Culver
*Attorney, Agent, or Firm*—Charles Y. Lackey

[57] ABSTRACT

A system for folding and packaging articles such as towels or T-shirts wherein, the article is partially folded over a cardboard insert and conveyed along a path at a selected speed through various folding locations until the article is completely folded, flattened, pressed, rotated if necessary and inserted into a bag which is subsequently sealed. The apparatus for performing such functions includes a reciprocating entry section for receiving one or more articles and folding the articles transversely over a cardboard insert. Blades for completely folding the articles longitudinally are readily adjustable relative to the machine frame and to each other vertically and horizontally to accommodate articles of various sizes and styles and to accommodate a single article or a plurality of articles.

12 Claims, 30 Drawing Figures

ARTICLE FOLDING AND PACKAGING SYSTEM

BRIEF SUMMARY AND OBJECTS OF THE INVENTION

This invention relates to a novel system for folding and packaging articles, particularly T-shirts and towels.

Briefly the present invention relates to the folding and packaging of articles in such a manner which results in increased production while achieving superior and tighter folds of the articles. Single or plural articles are combined with inserts and sequentially advanced through the apparatus along a prescribed path where the articles are completely folded, flattened, pressed, rotated and inserted into polyethylene bags which are subsequently sealed. A reciprocating entry section receives one or more articles and partially folds the articles over an insert as they are advanced toward a blade section which forms folds longitudinally of the article. A feed section folds the articles transversely and subsequently the articles are flattened, pressed, rotated 180° and inserted into a bag. The speeds of the various machine components can be readily controlled and the positioning of the various folding blades can be adjusted readily and accurately relative to each other and to the machine frame to receive articles of various sizes and styles.

One of the primary objects of the invention is the provision of an improved system for folding and packaging articles such as T-shirts and towels.

Another primary object of the invention is to combine in one relatively simple, continuous machine all of the operations necessary to soft package a substantially rectangular, flexible and flat article.

Still another object of the invention is the provision of a highly efficient folding and packaging machine having a greatly increased production capacity.

Still another object of the invention is a provision of an apparatus for readily adapting the various folding blades to fold a single article or simultaneously fold a plurality of articles effectively and accurately regardless of article size or style.

Other objects and advantages of the invention will become apparent when considered in view of the following detailed description.

DETAILED DESCRIPTION OF THE INVENTION

Figure 1:
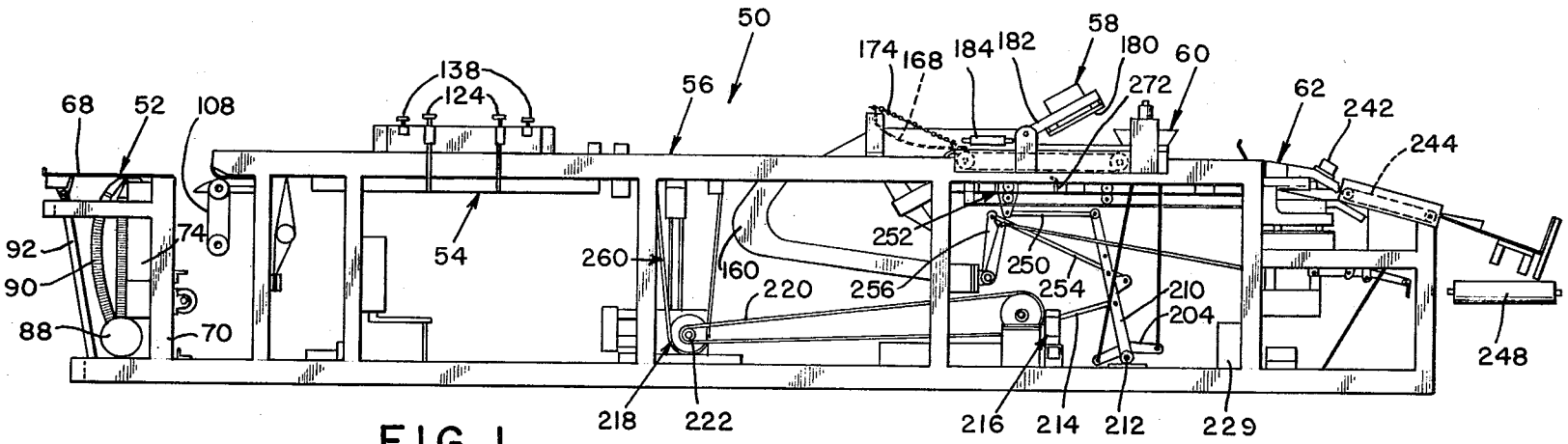
FIG. 1 is a schematic, side elevational view of one side of the machine.
Figure 3:
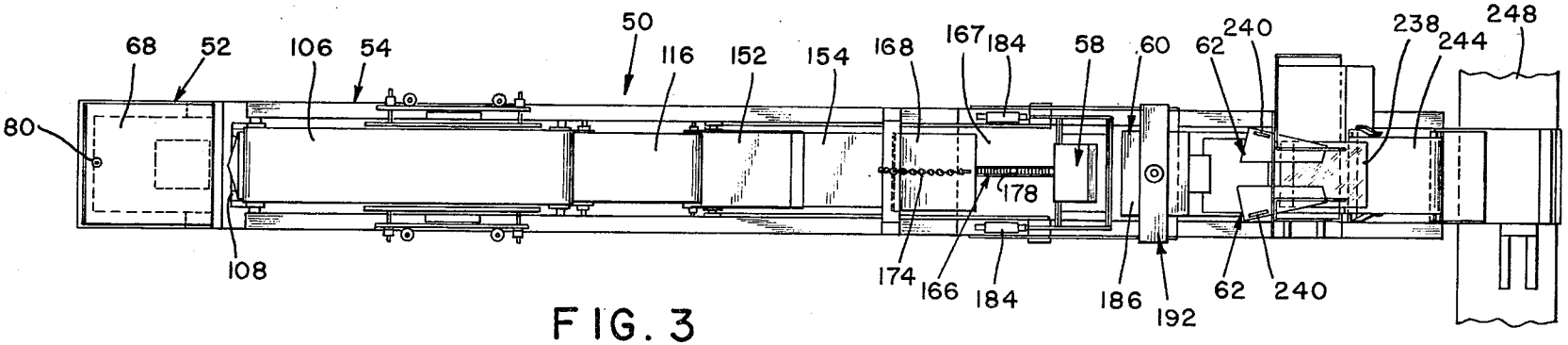
FIG. 3 is a schematic top plan view of the machine of FIGS. 1 and 2.
Figures 2, 23, 24, 25, 26, 27:
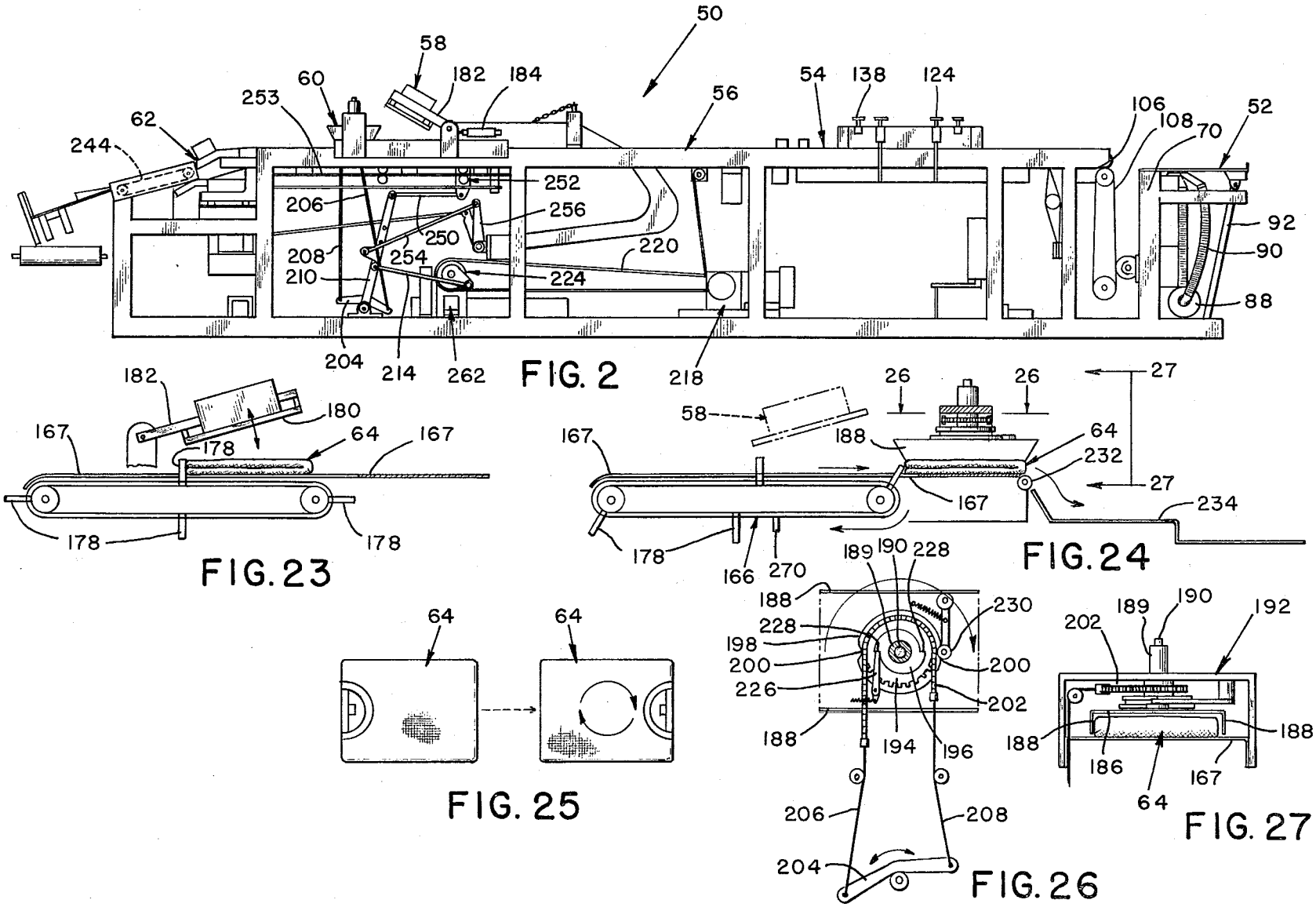
FIG. 2 is a schematic, side elevational view of the side of the machine opposite to that of FIG. 1.
FIG. 23 is an enlarged, schematic, fragmentary side elevational view of a mechanism for pressing the folded and flattened article.
FIG. 24 is an enlarged, schematic, fragmentary side elevational view of an assembly for rotating the pressed article ½° prior to its insertion into a bag.
FIG. 25 is a schematic, top plan view illustrating one article at the pressing position with a second article rotated 180°.
FIG. 26 is a schematic, fragmentary, top plan view taken along line 26—26 of FIG. 24, of the assembly for rotating the article 180°.
FIG. 27 is a schematic, fragmentary, view of the article rotating assembly taken along line 27—27 of FIG. 24.

Referring to the drawing and particularly to FIGS. 1–3, reference numeral 50 generally refers to the article folding and packaging machine which includes a displaceable article feed section 52, a section 54 for longitudinally folding the article, a feed section 56 for folding the article transversely, a heating assembly 58 for pressing the folded article, a turntable mechanism 60 for rotating the pressed article 180°, and a section 62 for packaging the folded and pressed article.

While the operation of the system will be described with reference to a single T-shirt being folded, flattened and pressed, rotated 180°, and inserted into a polyethylene bag, it is to be understood that two, three or more stacked T-shirts may be simultaneously folded, pressed and inserted into a single bag. However, the present invention is not limited to the folding and packaging of T-shirts, but may be useful for folding and packaging other relatively flat, flexible articles or garments.

The apparatus of the present invention is adapted to operate continuously at a selected speed resulting in a relatively high rate of production, for example, 400 dozen per hour.

Figure 4:
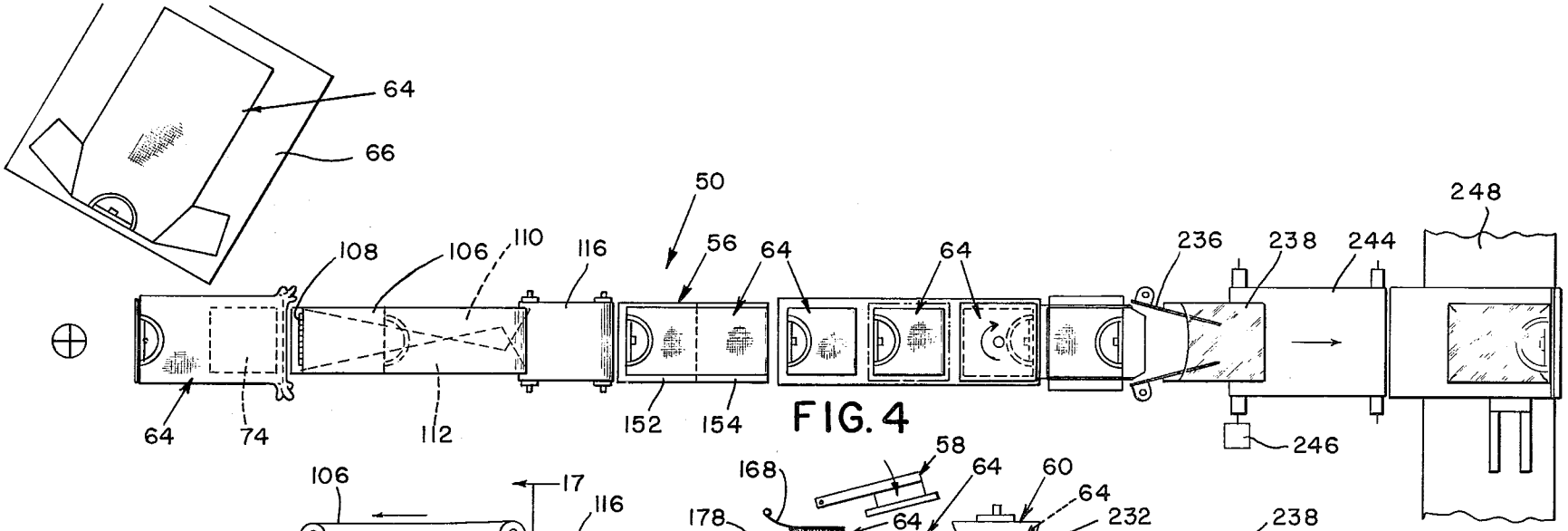
FIG. 4 is a fragmentary, schematic, top plan view of the apparatus illustrating the various operations performed on an article as it progresses through the machine to a receptacle.
Figure 5:
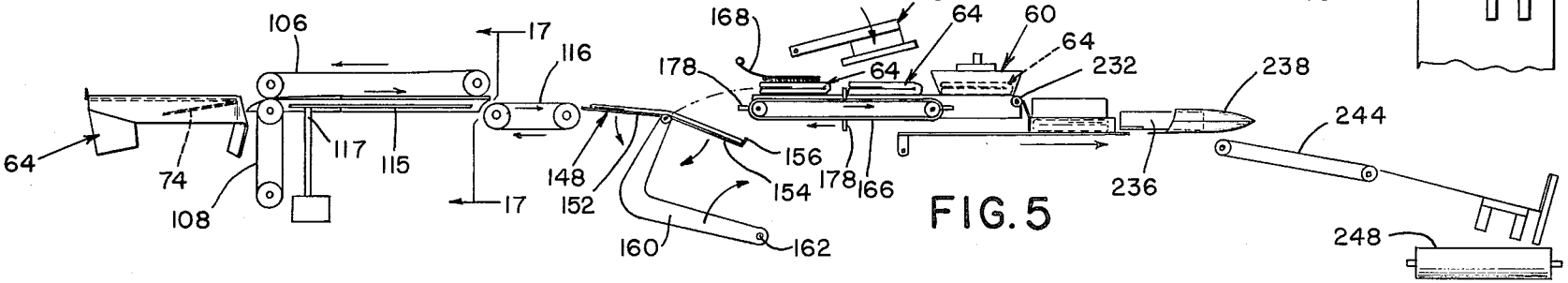
FIG. 5 is a fragmentary, schematic, side elevational view of the apparatus illustrating movement of the articles through the apparatus.
Figure 12:
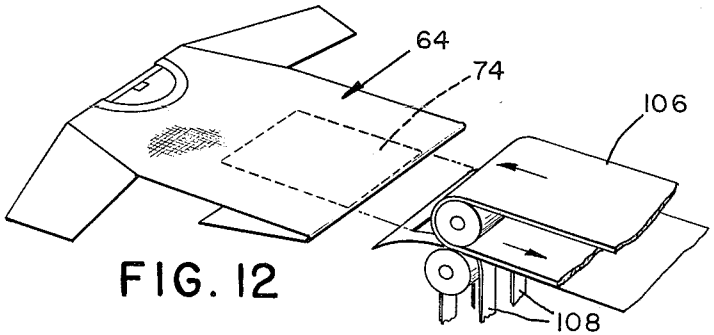
FIG. 12 is a schematic view of an article positioned upon an insert and being directed to the folding mechanism.

Referring to FIG. 4 and 5, a stack of T-shirts 64 readily accessible to an operator, is supported upon a table 66 adjacent one end of the machine 50. The operator grasps a shirt 64 from the stack and places it upon the tray 68 of the displaceable feed section 52.

The displaceable feed section 52, shown most clearly by FIG. 7–11, includes a frame 70 for supporting a magazine 72 of cardboard inserts 74. The inserts 74 are supported upon a base member 76 which is biased upwardly in a conventional manner to position the uppermost insert 74 adjacent a vacuum pick-up nozzle 78.

Figure 7:
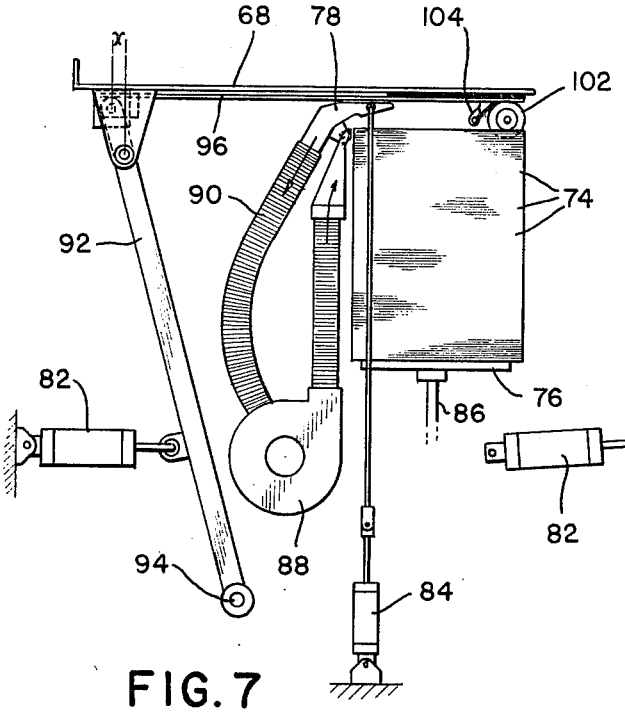
FIG. 7 is an enlarged, fragmentary, schematic, side elevational view of the mechanism for feeding the article to the folding mechanisms and for supplying and positioning the article on a cardboard insert.
Figure 8:
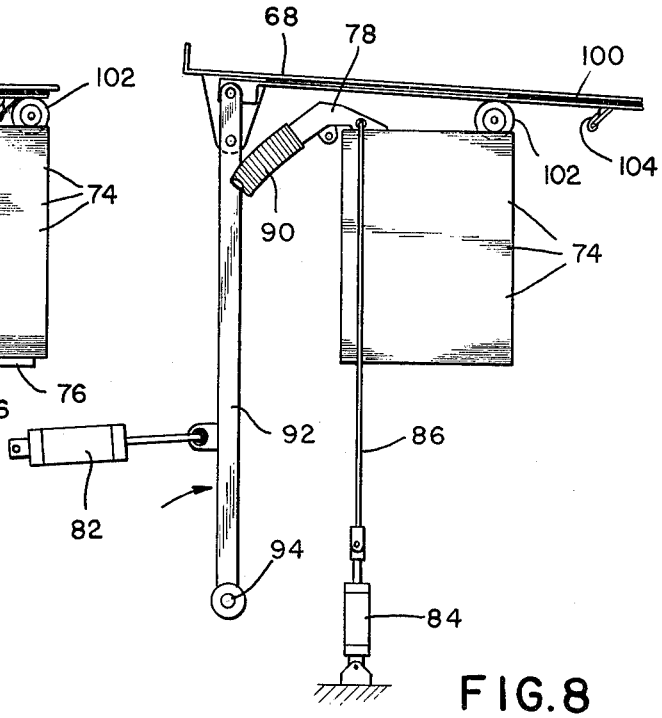
FIG. 8 is a view similar to FIG. 7 with an article support tray pivoted to a forward position.
Figure 9:
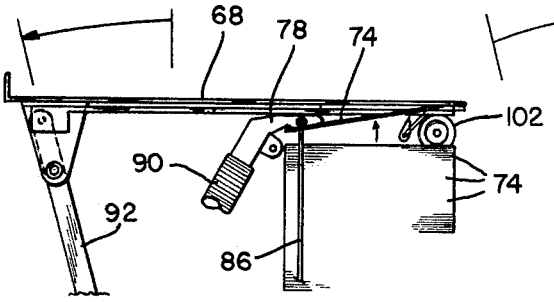
FIG. 9 is a schematic, fragmentary, side elevational view illustrating the mechanism for lifting and directing a cardboard insert from a supply magazine into engagement with an article being fed to the article folding apparatus.
Figure 10:
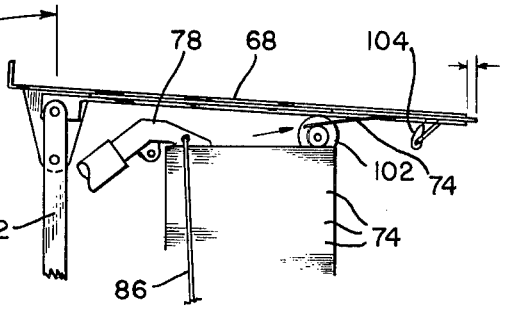
FIG. 10 is a view similar to FIG. 9 with the insert and feed plate in different position.
Figure 11:
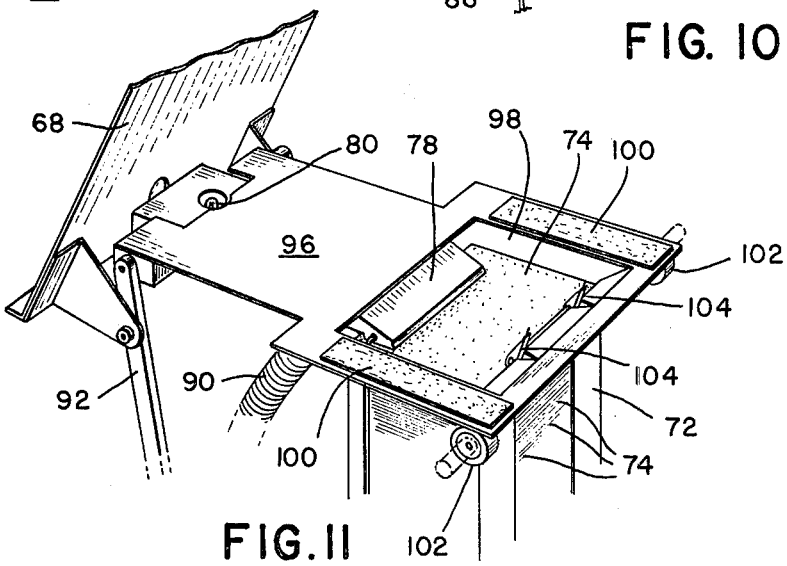
FIG. 11 is a schematic, fragmentary, perspective view of the insert magazine and the article feed and support plate.
Figure 18:
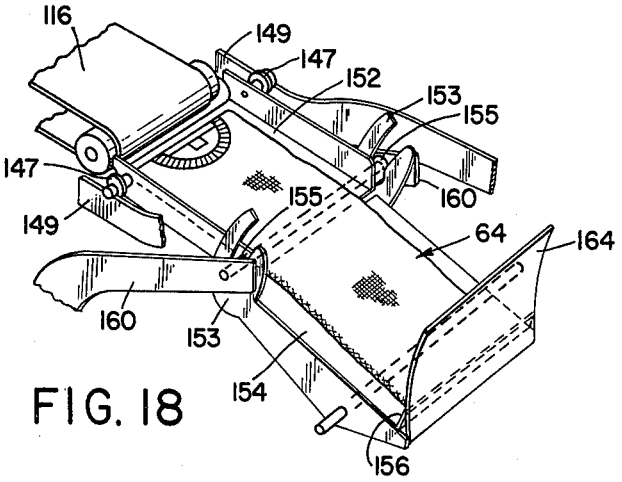
FIG. 18 is a schematic, perspective view of a longitudinally folded article positioned upon a displaceable, feed tray mechanism.

Positioning of a T-shirt 64 upon the tray 68 actuates a photoelectric cell 80, FIGS. 3 and 11, which, through a control system to be subsequently described, actuates fluid cylinders 82 and 84. Cylinder 84, through linkage 86, moves the vacuum nozzle 78 to the FIG. 9 position to lift an insert 74 while feed section 52 is in the forward position. The nozzle 78 is connected to a suitable vacuum source 88 by flexible hose 90. Fluid cylinder 82 urges the spaced, parallel levers 92, which are pivoted to the frame 70 at lower ends 94, between the position of FIG. 7 and the position of FIG. 8. The upper ends of levers 92 are pivoted to the tray 68 and the support 96. Support 96 is provided with an opening 98, FIG. 11, sufficiently large to permit a cardboard insert 74 to pass therethrough and into engagement with a T-shirt 64 upon tray 68. The objective is to provide a tray 68 on which to place the T-shirt to be folded, to make a cardboard insert available for each garment or group of garments laid on the tray, and to cause this cardboard to feed under the uppermost part of the T-shirt into the folding mechanism along with the T-shirt. This transverse fold is made during installation of the garment into the folder and the cardboard is inserted at the same time. FIG. 7 and subsequent figures show that there are actually two feed trays 68 and 96 which lie one over the top of the other and which are pivoted from the same operating arm 92 but from different points of radius from the center of rotation 94. Also tray 68 rests on low friction pads 100 which are fixed to support 96 so that there can be easy relative movement between the two. Because of the different hinge points of these two trays, as the arm 92 moves forward into the feeding position shown in FIG. 8, support 96 progresses forward at a faster rate than tray 68. As described, the forward end of both the hinged support and the hinged tray are carried on rollers 102. The suction pickup 78 which lifts one single cardboard from the top of stack 74 is coordinated in its up and down motion with the forward and backward movement of support 96 which is a part of the cardboard feeding mechanism. The support 96 is in the feed position show in FIG. 8.

The back end of a cardboard sheet is being grabbed by suction nozzle 78. As the support tray 96 begins to return to its backward or loading position shown in FIG. 7, nozzle 78 quickly raises to the position of FIG. 7 and the forward end of the cardboard is lifted through the hole in support 96 and into physical contact with the bottom of tray 68. As the support-tray assembly continues to return toward its rest position, the tip of the cardboard slips on the undersurface of the tray 68 until it first moves past oneway clutches 104 and then into the forward opening between support 96 and tray 68 provided by the thickness of friction pads 100. The cardboard is then still being held by suction nozzle 78 and by clutch pins 104 and in the slot between the support and the tray and flush with the front edge of tray 68. In FIG. 7 there is considerable cardboard extended beyond the front edge of support 96, but this rough cardboard edge is hidden by the extension of tray 68 so that shirt and cardboard do not contact as the shirt is being oriented. When the forward motion of the tray assemblies starts, the cardboard is held by clutches 104 and is dragged away from suction nozzle 78 which then drops down onto the cardboard stack to pick up another cardboard. The original cardboard protruding from support 96 progressively moves further out from under tray 68 as feeding takes place so that continued forward movement eventually pushes both the cardboard extension and the folded edge of the T-shirt into the nip of the folding belts.

Figure 6:
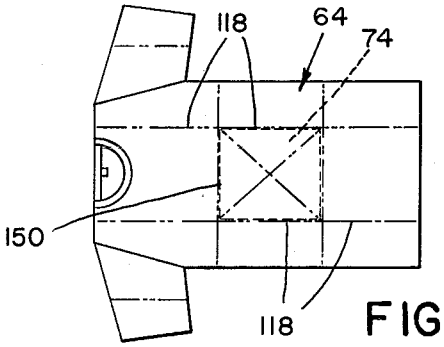
FIG. 6 is a top plan view of a T-shirt illustrating the various fold lines of the garment.
Figure 13:
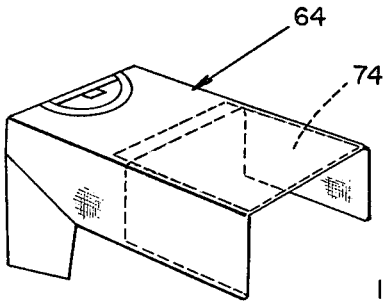
FIG. 13 is a schematic view of an article having a portion supported upon an insert and portions depending therefrom.
Figure 15:
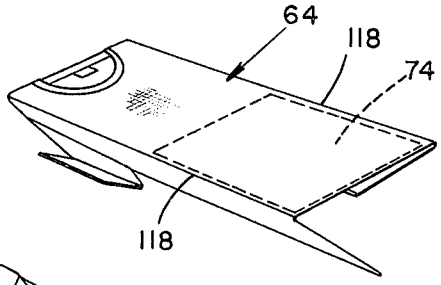
FIG. 15 is a schematic view of the article substantially folded by the folding blades and sleeve folder.
Figure 16:
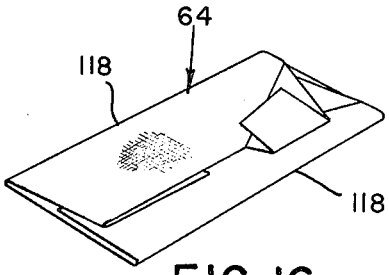
FIG. 16 is a schematic view of the folded article in inverted position illustrating the longitudinal folds in the article.
Figure 14:
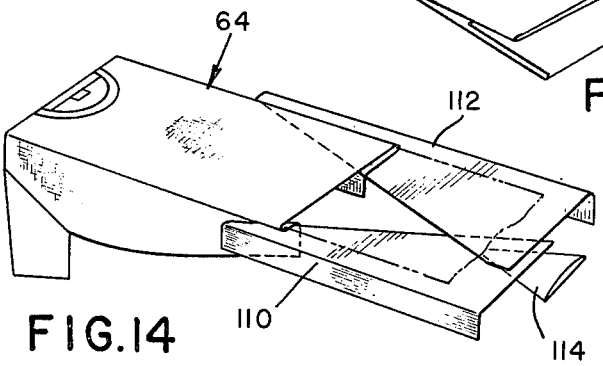
FIG. 14 is a schematic view of a partially folded article and the blades for folding the sides of the article.
Figure 17:
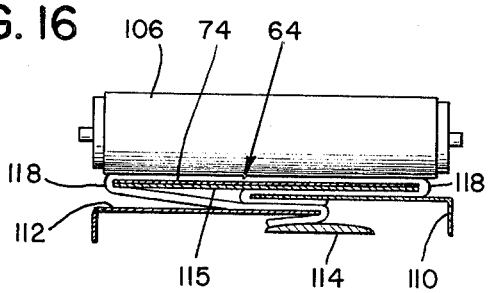
FIG. 17 is an enlarged, cross-sectional view taken along line 17—17 of FIG. 5 illustrating the insert, sleeve folder and folding blades.

The belts 106 and 108 feed the T-shirt and insert 74 into the machine section 54 for longitudinally folding the T-shirt 64 as shown by FIG. 14–17. Suitable support means are provided below the feed belt 106 for supporting a cardboard insert 74 and one or more T-shirts. In the preferred embodiment, the support means includes a relatively thin, polished, stainless steel plate 115, FIGS. 5 and 17, around which the shirt is folded. The polished plate 115 is supported in cantilever fashion from a central platform 117 attached to the machine frame. The central platfrom is positioned adjacent the vertical feed belts 108 and the plate 115 secured thereto is cantilevered downstream of the machine for the entire length of the article longitudinal folding blades 110, 112. Referring to FIGS. 14 and 17, blades 110 and 112, which have tapered or generally triangular surfaces, serve to progressively fold the article 64 longitudinally along the sides thereof as it is being advanced by the belt 106. Blades 110 and 112 fold the article along lines 118 as shown by FIGS. 6 and 16. The sleeve folder 114 is selectively disposed below blade 110, 112 together and positions the T-shirt sleeve as shown by FIG. 16. Note that the cardboard insert 74 is positioned above the blades 110, 112 while the article is folded longitudinally. After exiting from blades 110, 112, 114 and drive belt 106, the transversely and longitudinally folded article is deposited upon a feed conveyor 116 which transfers the article to the second transverse folder 56.

In order to provide superior and tighter folds in a single article or, plural articles and to facilitate the folding of a wide range of types and sizes of articles, a system had been provided to readily selectively position the blades 110, 112, 114 relative to each other, and to the polished fold support plate 115.

Figure 28:
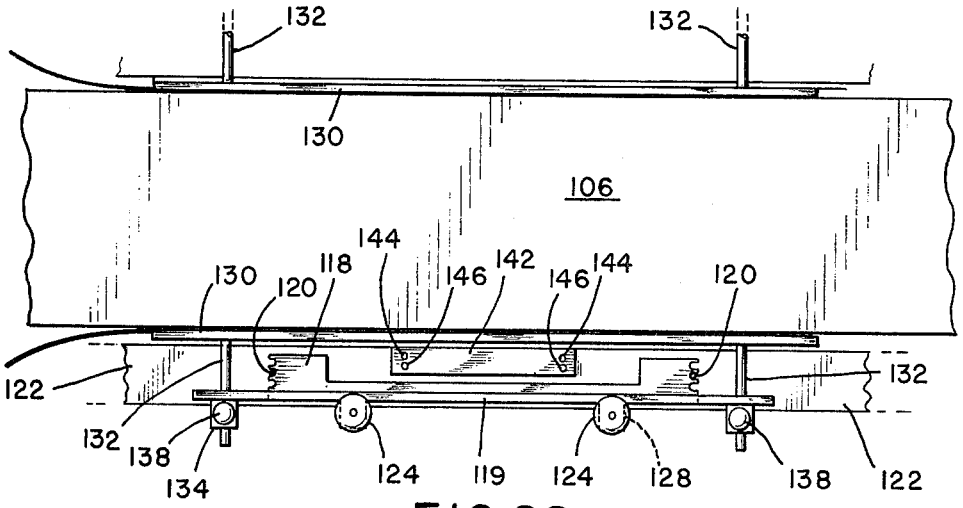
FIG. 28 is a fragmentary, schematic, top plan view of the machine illustrating the mechanism for adjusting the article folding blades.
Figure 29:
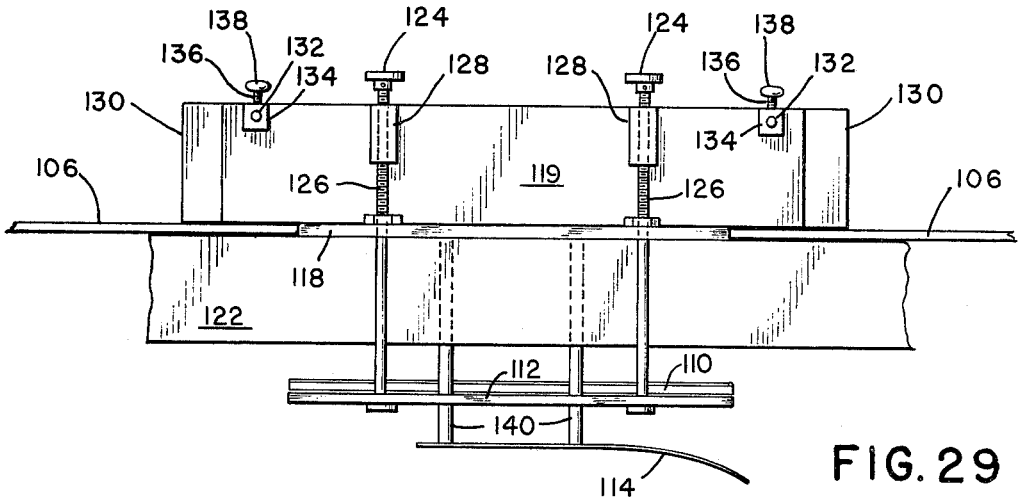
FIG. 29 is a schematic, side elevational view of the adjustment mechanisms of FIG. 28.
Figure 30:
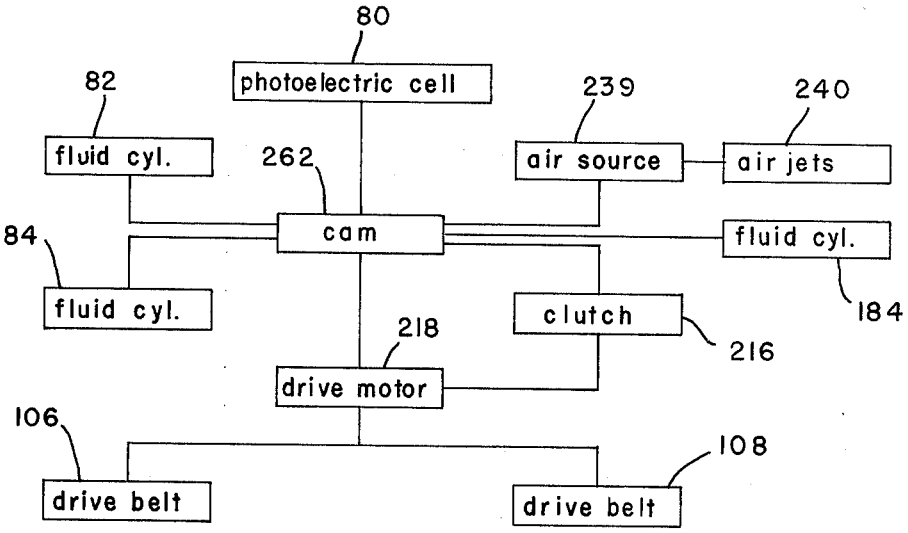
FIG. 30 is a simplified block and line diagram of various operational components of the machine.

Referring to FIG. 28 and 29, right angularly disposed plates 118 and 119 are adjustably secured by means of fasteners 120 upon a horizontally diposed member 122 of the machine frame. Threaded rods 126 having hand wheels 124 secured to the upper ends thereof extend through the machine frame members 122 and housing 128 and has the article folding blades 110, 112 attached to the lower ends thereof. Upon rotation of the pair of hand wheels 124, 124 on one side of machine, the corresponding blade, either blade 110 or blade 112, is raised or lowered vertically. Since each blade 110 and 112 is controlled individually, the blades can be adjusted relative to each other and relative to the machine frame to vary the vertical spacing between the blades 110, 112 and the elevation of the blades with respect to the conveyor belt 106. Adjustable fasteners 120 permit horizontal adjustment in the degree of overlap of the blades 110, 112.

Guide plates 130 are adapted to be adjusted horizontally, with respect to the belt 106, by means of rods 132, each of which has an end secured to a plate 130 and the other end slidably received within openings in plate 119 and housing 134. Fasteners 136, having hand knobs 138 secured thereto, are threadably received in housings 134 and selectively engage the rods 132 to retain the rods 132 and guide to plate 130 in various positions of adjustment. The location of the T-shirt sleeve folder 114 may be adjusted in a generally horizontal plane transversely of the belt 106 by members 140 attached to the folder 114 and the plate 142 adjustably positioned upon machine frame 122 by fasteners 144 is selected plate openings 146.

After being deposited upon the displaceable, feed tray 148 by the feed conveyor 116 the T-shirt 64 is folded transversely along line 150, FIG. 6.

The displaceable feed tray 148 includes a first article support member 152 and a second support member 154 provided with an abutment 156 for stopping the forward movement of the T-shirt from feed belt 116. Spaced, parallel, curved levers 160, each pivotably mounted adjacent one end upon the machine frame by pins 162, are joined at their upper ends by a shaft 158. Support member 152 is pivoted at its downstream edge to the shaft 158. The opposite end of tray member 152 rests upon follower members 147 that ride upon the upper edges of cam tracks 149. Therefore, the edge of tray member 152 provided with teeth 151 substantially follows the arc of the outer ends of pivoted levers 160 while the other end of the tray member 152 follows the tracks 149. The downstream end of tray member 154, which is terminated by stop 156 is pivoted at approximately the same location. Cams 153 are rigidly connected to the opposite end of member 154 and move with followers 155 which are free to rotate on shaft 158. As the nose of tray member 152 moves upward and forward, the cams 153 cause tray member 154 to follow until it is approximately vertical whereupon followers 155 disengage the cams 153 and permit tray member 152 to complete the forward stroke. The tray 154 is smoothly picked up again on the return stroke by the followers 155 and cams 153.

The levers 160 are pivotably mounted upon the machine frame by pins 162 and upon pivotable displacement by a suitable means, the displaceable support members 152 and 154 progressively fold and feed the T-shirts 64 forward, as shown by FIG. 19–22.

A curved guide plate 164, fixed to member 154, facilitates folding and guiding of the T-shirt to chain conveyor 166 and table 167. As the pivotable displacement of the levers 160 feed the member 152 and T-shirt 64 upon the conveyor 166, a heavy, arcuate plate 168 located above a portion of the conveyor 166 also serves to facilitate folding of the advancing T-shirt and retains the folded T-shirt in a flattened condition upon the table 167 upon withdrawal of member 152 by rocking of levers 160. The heavy plate 168 is pivotably mounted adjacent one end at 170 upon upright support 172 secured to the machine frame and a chain 174 extends between the upright support 172 and fastener 176 secured adjacent the opposite end of the heavy plate. The chain 174 may be adjustably secured to fastener 176 to vary the degree of pressure applied by the heavy plate to a folded T-shirt positioned upon table 167.

Figure 19:
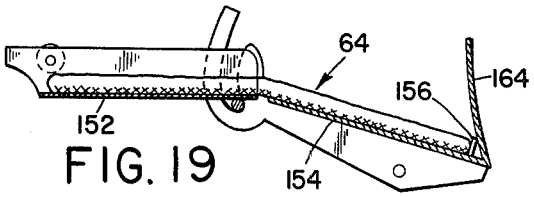
FIG. 19 is a schematic, side elevational view of the feed tray mechanism having a longitudinally folded article thereon.
Figure 20:
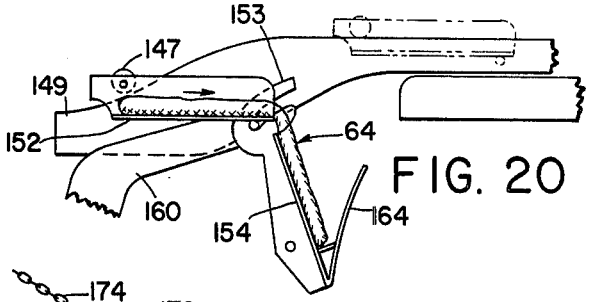
FIG. 20 is a view similar to FIG. 19 with the feed tray mechanism being displaced to fold the article transversely.
Figure 21:
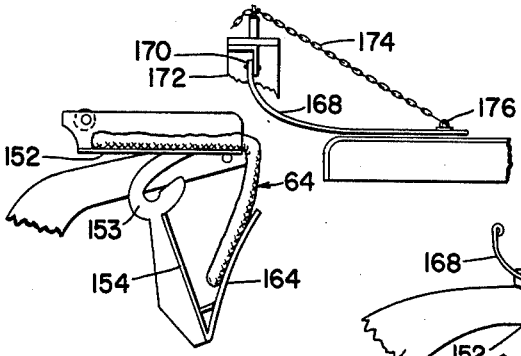
FIG. 21 is a schematic side elevational view of the displaced article being directed by the feed tray mechanism between a guide and a pivoted plate.
Figure 22:
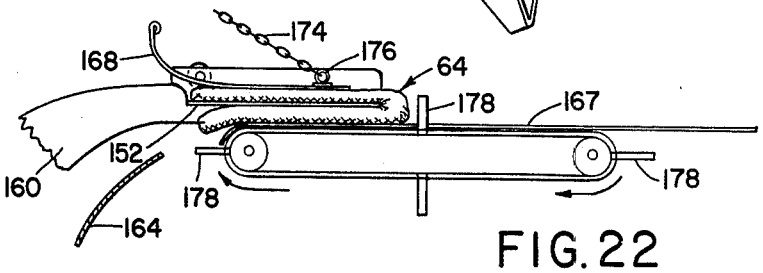
FIG. 22 is a schematic, side elevational view of the transversely folded article clamped between the pivoted plate and a conveyor.

Upon displacement of the folding and feeding members 152, 154 back to the positions of FIGS. 5 and 19, the folding T-shirt is advanced by a pusher finger 178 carried by the endless conveyor chain 166 to a prescribed location adjacent the heating and pressing assembly 58.

The heating and pressing assembly 58 includes a hot plate 180 attached to levers 182 which are pivotably mounted upon the machine frame, FIGS. 1 and 2 and the T-shirt pressing position by fluid cylinders 184.

The pressed article is advanced by a pusher finger 178 to turntable mechanism 60 where the folded and pressed article is rotated 180 degrees, as shown by FIG. 25, prior to being deposited in a polyethylene bag.

The turntable mechanism 60 includes a rotatable plate 186 having two spaced, parallel, depending flanges 188 for engaging the rotating an article upon a table 167. The rotatable plate 186 is supported by sleeve 189 upon pin 190 which, in turn, is mounted upon the machine frame by structure 192. Also secured for rotation with sleeve 189, plate 186 and flanges 188 are a sprocket 194, FIG. 26, a plate 196, and a disc. 198. The disc 198 is provided with indentations 200 disposed 180° apart. A chain 202 has the ends thereof connected to the ends of lever 204 by an elongated combined springs and cables 206, 208, FIG. 26. The lever 204 is fixed adjacent the lower end of a lever 210, FIGS. 2 and 3, which, in turn, rocks on the frame about pivot pin 212 in response to the displacement of a rod or lever 214. The lever 214 is actuated by a clutch 126 which is driven from a variable speed motor 128 through chain 220 and sprockets 222, 224.

Actuation of clutch 216 pivots levers 210 and 204 which results in displacement of chain 202, and the indexing of sprocket 194, plate 196, disc 198, plate 186 and flanges 188 approximately 180 degrees in a clockwise direction. The spring biased pawl 226 is pivoted upon the structure 192 and rides upon the outer, accurate surface of plate 196. Upon 180° clockwise rotation, the pawl pivots inwardly and engages one of the abutments 228 of plate 196 to prevent reverse rotation of the plates 196 and 186 as the levers 204 and 210 rock in the reverse direction. Spring biased roller 230 is received within one of the indentations 200 of disc 198 to prevent unintentional displacement of the turntable plate 186 and flanges 188 until the levers 204, 210 again are actuated by the clutch 216.

Upon 180 degree rotation of an article by the turntable, the chain conveyor 166 urges another article between the flanges 188, 188 and forces the previously rotated article over the guide rollers 232 and onto a loading tray 234. The loading tray or shovel 234 is mounted for reciprocation with the indexing mechanism 252. Actuation of clutch 216 pivots levers 210, 250 and reciprocates the wheeled mechanism 252 along tracks 253 resulting in displacement of loading tray or shovel 234 to advance a folded and pressed T-shirt 64 through the horns 236 and into a bag member 238. Displacement of shovel 234 also serves to rip the bag from a wire wicket retainer, not shown, and urges the bag and T-shirt beyond suitable stop members which prevent reverse movement of the packaged T-shirt as the shovel or loading tray 234 retracts to its initial position, as shown by FIG. 24.

A plurality of stacked bags 238 are stored within a magazine and spring biased upwardly in a conventional manner. Air jets 240 which receive air pressure from a suitable source 239 initially open the uppermost of the stack of bags 238. A fan 242 maintains the center of the bag in an opened condition until the folded T-shirt is received within the bag. An endless conveyor belt 244, driven by variable speed motor 246, transfers the packaged T-shirt to another conveyor 248, FIGS. 4 and 5.

The conveyor chain 166 is mechanically, intermittently, advanced exactly the correct distance by one of a series of latches 270, FIG. 24, on the return flight of the chain 166 catching a hook 272, FIG. 1, on the reciprocating indexing mechanism 252.

In addition, the clutch 216 and lever 210 also control the pivoting of the lever 160 and hinged support members 152, 154 by means of the levers 254 and 256.

Article feed conveyor 106, 116 and drive belts 108 are driven from variable speed motor 218 in a conventional manner through the chain and sprocket drive arrangement 260.

The various fluid cylinders 82, 84, 184, the air jets 240, and clutch 216 are controlled by various switches, solenoid valves, etc., in a conventional manner through a cam controlled mechanism 252 upon actuation of the photoelectric cell 80 when an operator places one or more T-shirts upon the table 68.

I claim:

1. The method of folding an article about an insert as the article is advanced along a prescribed path comprising the steps of; initially positioning at rest a relatively flat flexible article having a first portion in generally parallel superposed spaced relation above an insert positioned at rest, and having a second portion depending below the insert, simultaneously initiating displacement of and advancing the article and insert at different rates generally along the prescribed path of travel while retaining the article first portion in superposed spaced relation above the insert to feed an edge of the insert into contact with the article second portion to initiate folding of the article transversely of the prescribed path of travel, feeding the insert and transversely folded article along the prescribed path of travel while folding the article longitudinally of said path of travel, and subsequently folding the article about the insert transversely of the prescribed path of travel.

2. An apparatus for folding articles comprising; means for conveying an article along a prescribed path of travel, reciprocable means for receiving an article to be folded and for folding the article transversely over an insert while simultaneously feeding the insert and the article to said conveying means, and means for folding longitudinally the article about the insert as the transversely folded article is displaced along said path, said reciprocable means including means for advancing a leading edge of the insert generally longitudinally of the prescribed path of travel into contact with the article and to said conveying means, said advancing means including a feed tray for initially receiving the article to be folded, a support tray means for directing an insert from a supply source to said conveying means, and means mounting said feed tray and said support tray for movement relative to each other generally in the longitudinal direction of the prescribed path of travel, said feed tray and said support tray means being positioned in superposed relation.

3. Apparatus as recited in claim 2, and further including displaceable feed tray means for applying a second transverse fold to said article subsequent to said longitudinal folding means.

4. Apparatus as recited in claim 3, said displaceable feed tray means including first and second article support members mounted in spaced relation, means for displacing one of said first and second article support members to initiate the second tranverse fold, and means for displacing the other member of said first and second article support members in response to displacement of said one member.

5. Apparatus as recited in claim 3, and further including means for applying pressure to each transversely folded article to flatten each article.

6. Apparatus as recited in claim 3, and further including means for heating and pressing each transversely folded article.

7. Apparatus as recited in claim 6, and further including means for rotating the folded and pressed article 180° prior to depositing the article within a receptacle.

8. Apparatus as recited in claim 7, wherein a plurality of stacked articles are simultaneously folded, pressed, rotated 180° and deposited within a single receptacle.

9. An apparatus for folding articles comprising; a frame, means upon said frame for conveying an article along a prescribed path of travel, means for folding each article transversely of said path of travel as said article is displaced along said path, said means for transversely folding an article including first and second support members for receiving an article thereon, said first and second support members being initially aligned in end to end relation generally longitudinally of said path for receiving an article and having adjacent edges in spaced relation, and means for simultaneously displacing upwardly the adjacent edges of said first and second support members a prescribed distance to initiate the transverse fold in the article, said means for displacing upwardly the adjacent edges of said first and second support members including means releasably coupling said first and second support members.

10. Apparatus as recited in claim 9, said releasable coupling means permitting continued displacement of one member of said first and second support members relative to the other member of said first and second support members beyond said prescribed distance.

11. An apparatus for folding articles displaced along a prescribed path comprising; a frame, means upon said frame for conveying an article, a reciprocable article support member, means supporting an insert adjacent the article support member in spaced relation to an article positioned upon said article support member, said insert supporting means and said article support member being in superposed relation, and means for simultaneously advancing said article support member and said insert supporting means towards said conveying means, said advancing means including means for feeding said insert supporting means at a faster rate of travel than said article support member to bring an insert into contact with the article prior to the insert and article reaching the conveying means.

12. Apparatus as recited in claim 11, said means supporting an insert including a member having an opening therein for receiving an insert therethrough, and means for gripping the insert to displace the insert with said member having an opening therein.

* * * * *